US011608958B2

(12) United States Patent
Rotaris et al.

(10) Patent No.: US 11,608,958 B2
(45) Date of Patent: Mar. 21, 2023

(54) AUTOMOTIVE LIGHTING AND/OR SIGNALING DEVICE EQUIPPED WITH AN EXTERNAL DECORATIVE ELEMENT AND RELATED ASSEMBLY METHOD

(71) Applicant: MARELLI AUTOMOTIVE LIGHTING ITALY S.p.A., Venaria Reale (IT)

(72) Inventors: Francesca Rotaris, Tolmezzo (IT); Antonio Zamolo, Tolmezzo (IT); Carlo Moroldo, Tolmezzo (IT)

(73) Assignee: MARELLI AUTOMOTIVE LIGHTING ITALY S.p.A., Venaria Reale (IT)

( * ) Notice: Subject to any disclaimer, the term of this patent is extended or adjusted under 35 U.S.C. 154(b) by 0 days.

(21) Appl. No.: 17/536,794

(22) Filed: Nov. 29, 2021

(65) Prior Publication Data

US 2022/0170608 A1 Jun. 2, 2022

(30) Foreign Application Priority Data

Nov. 30, 2020 (EP) ..... 20210690

(51) Int. Cl.
*F21S 41/55* (2018.01)
*F21S 43/50* (2018.01)
(Continued)

(52) U.S. Cl.
CPC ..... *F21S 41/55* (2018.01); *F21S 41/285* (2018.01); *F21S 41/29* (2018.01); *F21S 43/27* (2018.01); *F21S 43/51* (2018.01); *F21V 17/101* (2013.01)

(58) Field of Classification Search
CPC .. F21S 41/50; F21S 41/55; F21S 43/50; F21S 43/51
See application file for complete search history.

(56) References Cited

U.S. PATENT DOCUMENTS 3,687,502 A 8/1972 Loew
5,532,045 A 7/1996 Wade
(Continued)

FOREIGN PATENT DOCUMENTS

DE 102004025232 A1 1/2006
EP 3263976 A1 1/2018
JP H11321434 A 11/1999

OTHER PUBLICATIONS

Communication dated Apr. 23, 2021 transmitting the Search Report for European Patent Application No. 20210690.2 dated Apr. 15, 2021.

*Primary Examiner* — Sean P Gramling
(74) *Attorney, Agent, or Firm* — Howard & Howard Attorneys PLLC

(57) ABSTRACT

A lighting and/or signaling device, in particular for the automotive industry, comprising a container body which delimits a containment housing closed by a lenticular body, which accommodates at least one light source adapted to emit a light beam which at least partially crosses the lenticular body, at least one decorative element, applied on an external wall of the lenticular body, opposite to the containment housing. An internal wall of the decorative element, directly facing the external wall of the lenticular body, comprises at least one welding pin, which creates a welding point with the lenticular body. At least one spacer element defines a minimum clearance and a volume or gap between the external wall of the lenticular body and the internal wall of the element decorative element. At least one conveyor element favors the outflow of liquids which have penetrated through the clearance into the volume.

16 Claims, 5 Drawing Sheets

(51) Int. Cl.

| | |
|---|---|
| ***F21S 43/27*** | (2018.01) |
| ***F21S 41/29*** | (2018.01) |
| ***F21S 41/20*** | (2018.01) |
| ***F21V 17/10*** | (2006.01) |

(56) References Cited

U.S. PATENT DOCUMENTS

| | | | |
|---|---|---|---|
| 2005/0266762 | A1 | 12/2005 | Yasuda et al. |
| 2015/0204500 | A1 | 7/2015 | Japs et al. |

AUTOMOTIVE LIGHTING AND/OR SIGNALING DEVICE EQUIPPED WITH AN EXTERNAL DECORATIVE ELEMENT AND RELATED ASSEMBLY METHOD

CROSS-REFERENCE TO RELATED APPLICATIONS

The present application claims priority to and all the benefits of European Patent Application No. 20210690.2, filed on Nov. 30, 2020, which is hereby expressly incorporated herein by reference in its entirety.

BACKGROUND OF THE INVENTION

1. Field of the Invention

The present invention relates to an automotive lighting and/or signaling device equipped with an external decorative element and related assembly method.

2. Description of the Related Art

The term automotive lighting and/or signaling device is used here in a very broad sense to comprise an automotive light, either rear or front, the latter also named a headlight or headlamp.

As known, an automotive light is a device intended to provide at least one lighting and/or signaling function of the vehicle, such as a position light, a turn signal, a brake light, a rear fog lamp, a reversing lamp, a dipped beam headlamp, a main beam headlamp and the like.

Furthermore, the term is also understood to comprise a ceiling light, a dashboard or part thereof; thus, the automotive lighting and/or signaling device may be placed either inside or outside the vehicle.

As known, the automotive lighting and/or signaling devices substantially comprise a hollow container body, which internally accommodates at least one light source, and which is closed by an external lenticular body.

The light source, preferably of the LED type, is coupled for example with at least one light guide which receives the light beam produced by the light source and transmits it towards the lenticular body, conventionally by total internal reflection (TIR).

For aesthetic reasons, the lighting and/or signaling devices may be equipped with decorative elements external to the container body. Such decorative elements are often equipped with chromed parts.

Embellishing the lighting and/or signaling device with the use of such external decorative elements involves a series of technical difficulties to be overcome.

In order to associate an external decorative element to the light, a stable and lasting coupling must in fact be achieved between the external surface of the lenticular body and an internal wall of the decorative element associated therewith.

Such coupling may be achieved by means of gluing or welding.

The solutions providing gluing, however, have the drawback related to the deterioration of the glue, which may lose the physicochemical properties thereof and yield, over time, both due to the direct action of atmospheric agents and due to the continuous vibrations and thermal stress to which the lighting and/or signaling device is subjected during the operation thereof.

In order to overcome the latter technical problems, protecting the perimeter of the glued parts with suitable perimeter seals is known. The use of such gaskets, however, entails a further increase in the components used, in the overall costs of the lighting and/or signaling device and in the assembly steps of the light itself.

In recent automotive lighting and/or signaling devices it is therefore preferred to join the decorative element to the lenticular body by means of a welding process, for example, ultrasonic or laser. However, a configuration or excessive size of the welding joints may cause the formation of a gap between the decorative element and the lenticular body at the end of the welding process. Such gap may be the site of infiltration of dirt and especially of water which, in case of ice, may, by expanding, cause the detachment of the decorative element.

For all these reasons, also the welded solutions of the prior art have drawbacks which are not negligible.

SUMMARY OF THE INVENTION

The need is thus felt in the art to make available an automotive lighting and/or signaling device equipped with a decorative element which makes it possible to solve the technical problems mentioned with reference to the prior art.

Such need is met by an automotive lighting and/or signaling device according to claim 1 and by an assembly method of an automotive lighting and/or signaling device according to claim 13.

Other embodiments of the present invention are described in the dependent claims.

BRIEF DESCRIPTION OF THE DRAWINGS

Further features and advantages of the present invention will become more understandable from the following description of preferred and non-limiting embodiments thereof, in which.

Elements or parts of elements in common between the embodiments described will be indicated hereinafter using the same reference numerals.

DETAILED DESCRIPTION OF THE INVENTION

Figure 1:
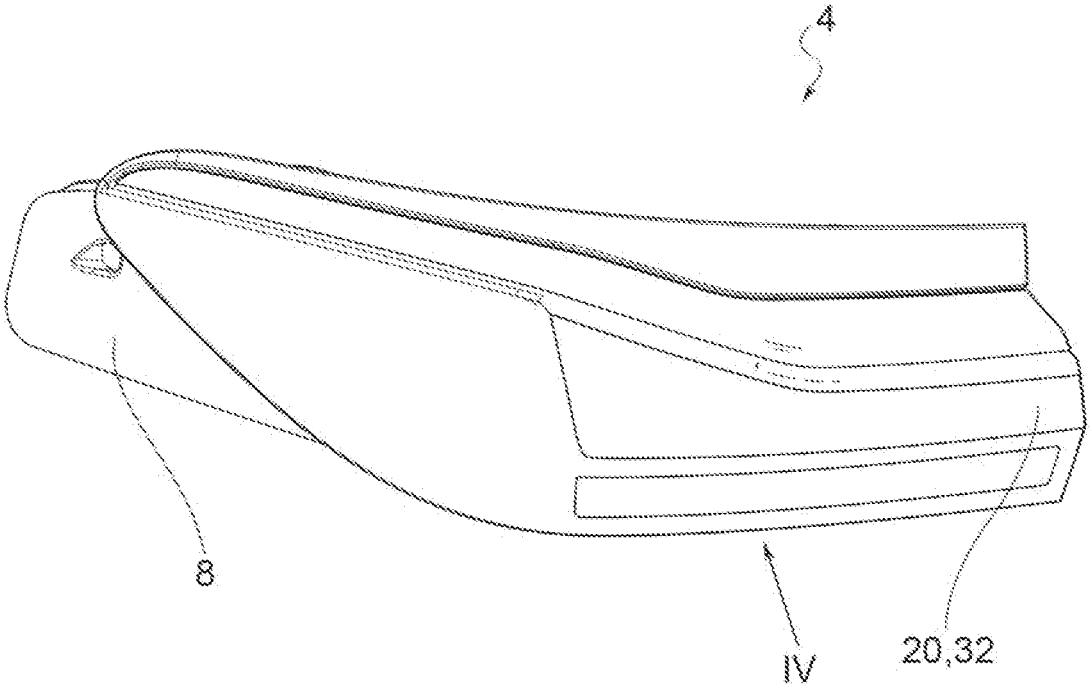
FIGS. 1-2 show a perspective view, in an assembled configuration and from different angles, of a lighting and/or signaling device according to an embodiment of the present invention.
Figure 2:
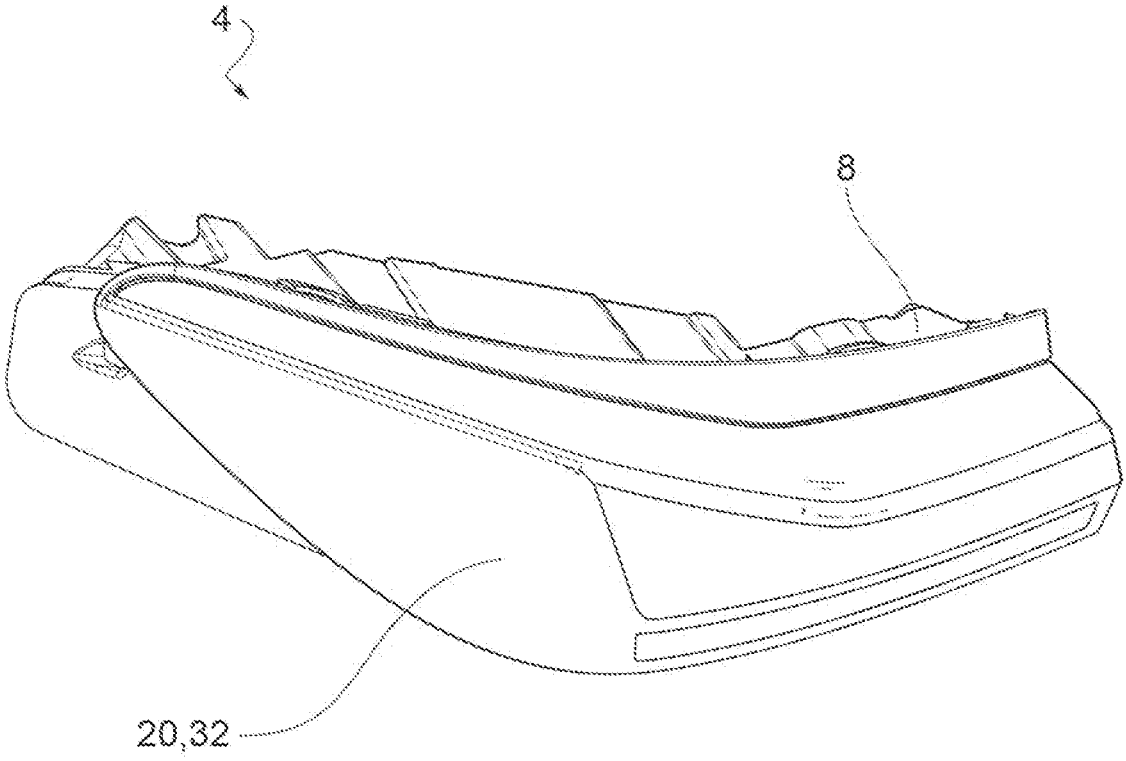
Figure 3:
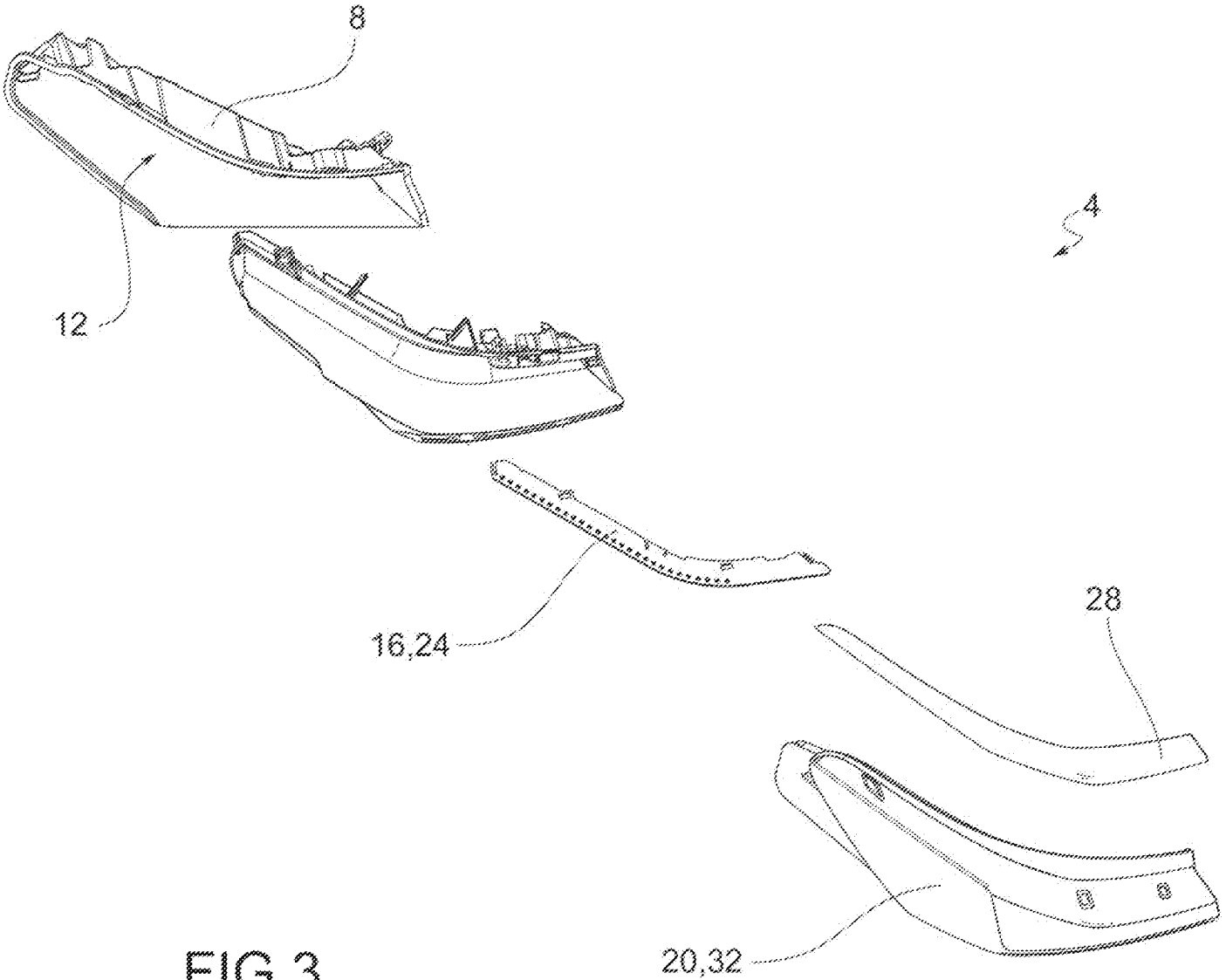
FIG. 3 shows a perspective view, in separate parts, of the lighting and/or signaling device of FIGS. 1-2.
Figure 5:
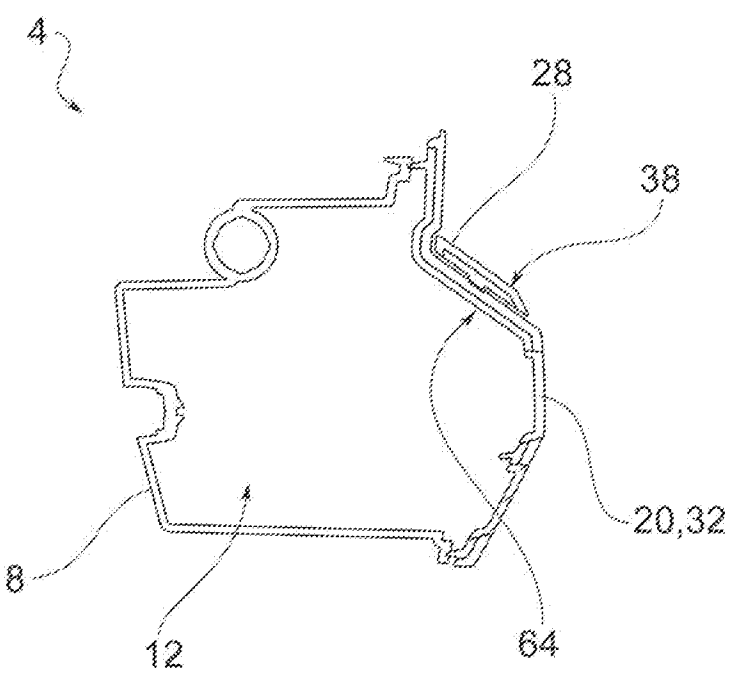
FIG. 5 shows a sectional view of the lighting and/or signaling device of FIG. 4, taken along the section plane V-V of FIG. 4.
Figure 4:
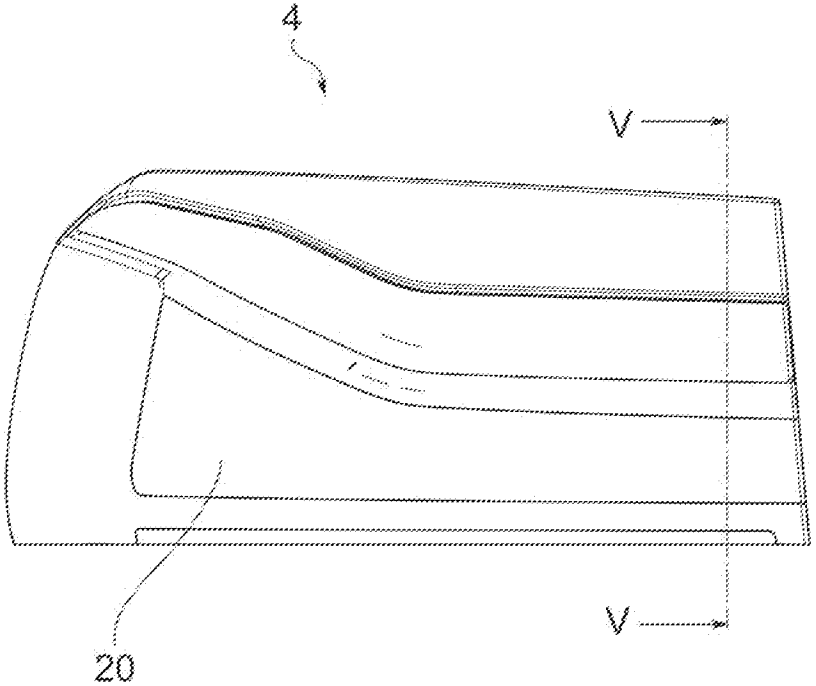
FIG. 4 shows a front view of the detail IV shown in FIG. 1.

With reference to the aforesaid Figures, reference numeral 4 overall indicates a lighting and/or signaling device, such as an automotive light, to which reference will be made hereinafter without, for this reason, losing in generality.

As mentioned above, the expression "lighting and/or signaling device" refers to either an automotive rear light or an automotive front light, the latter also known as headlight or headlamp, comprising at least one light external to the vehicle having a lighting and/or signaling function, such as, for example, a position light, which may be a front position light, a taillight, a side marker, a turn signal, a brake light, a rear fog lamp, a main beam headlamp, a dipped beam headlamp, and the like.

Furthermore, the term lighting and/or signaling device also refers to an interior ceiling light, a dashboard or part of it, a display and so on.

Therefore, as better described in greater detail below, in the signaling function thereof, the device may comprise the possibility of sending light signals, logos, but also writings and light messages of any kind.

The lighting and/or signaling device 4 comprises a container body or housing 8, usually made of polymeric material, such as acrylonitrile-butadiene-styrene or ABS, which typically allows the fixing of the lighting and/or signaling device 4 to the respective vehicle or any type of support of the vehicle.

For the purposes of the present invention, the container body or housing 8 may have any shape, size or position: for example, the container body 8 may also not be directly connected to the bodywork or other external fixings of the associable vehicle.

As shown, the container body 8 may also be fixed inside the vehicle, e.g., on the dashboard, rear shelf and so on.

The container body 8 delimits a containment housing 12 which accommodates a plurality of components of the lighting and/or signaling device.

In particular, the containment housing 12 accommodates a plurality of light sources 16, comprising, for example, LEDs, OLEDs, lasers, arranged and supported within the containment housing 12.

For example, a lenticular body 20 may be placed at least partially closing the container body 8, so as to close the containment housing 12 which accommodates the at least one light source 16.

For the purposes of the present invention, the lenticular body 20 may be external to the lighting and/or signaling device 4, so as to define at least one external wall of the lighting and/or signaling device directly subject to the atmosphere.

According to possible embodiments, the material of the lenticular body 20 is polymeric, i.e., a resin such as PMMA (polymethyl methacrylate), PC (polycarbonate) and the like. The material of the lenticular body is thus at least partially transparent or semi-transparent or translucent and may also comprise one or more opaque portions.

The lenticular body 20 is thus adapted to be crossed, at least partially, by the light beam produced by the light sources 16, which is transmitted outside the containment housing 12, as better described below.

According to a possible embodiment, at least one light guide 24, made of a transparent polymeric material, such as PC, PMMA or the like, may also be accommodated inside the containment housing 12. The light sources 16 accommodated in the containment housing 12 are, for example, intended to supply exactly such at least one light guide 24. The latter is thus configured to receive as input, at least partially, the light beam produced by at least one light source 16, transmit it by total internal reflection and send it as output from the containment seat 12, through the lenticular body 20.

The lighting and/or signaling device 4 further comprises at least one decorative element 28, for example, opaque with respect to the light beam emitted by the at least one light source 16 and applied to an external wall 32 of the lenticular body 20, opposite with respect to the containment seat 12. In other words, the external wall 32 is external with respect to the lighting and/or signaling device 4 and directly faces an external observer.

In one embodiment, the decorative element 28, at an external face 38 thereof, opposite to the internal wall 36, comprises a chromed portion.

Obviously, various alternatives are possible to achieve the decorative function on the external face 38 of the decorative element 28.

An internal wall 36 of the decorative element 28, directly facing the external wall 32 of the lenticular body 20, comprises at least one welding pin 40, which creates a welding point with the lenticular body 20.

In other words, the welding pin 40 produces a mechanical fixing of the decorative element 28 on the external wall 32 of the lenticular body 20, as better described below.

In one embodiment, the welding pin 40 is made of an opaque material.

The internal wall 36 of the decorative element 28 further comprises at least one spacer element 44 which determines a minimum clearance 48 and a volume or gap 52 between the external wall 32 of the lenticular body 20 and the internal wall 36 of the decorative element 28.

In other words, the spacer element 44 defines a minimum distance or clearance 48 between the decorative element 28 and the lenticular body 20. Obviously, such minimum distance or clearance 48 is measured locally along the line perpendicular to respective planes tangent to the external wall 32 of the lenticular body 20 and to the internal wall 36 of the decorative element 28.

The presence of such minimum clearance 28 also defines an open volume 52 delimited between the external wall 32 of the lenticular body 20 and the internal wall 36 of the decorative element 28.

In one embodiment, the minimum clearance 48 may be in the order of 0.1-3 mm.

The internal wall 36 of the decorative element 28 further comprises at least one conveyor element 56 which favors the outflow of liquids and/or dirt which may have penetrated through the minimum clearance 48 in the volume 52.

According to a possible embodiment, the conveyor element 56 has the configuration of a fin having an inclination such as to favor the outflow of liquids downwards. Obviously, the conformation of the conveyor element 56 must be established according to the position which the latter will assume in the final use, i.e., when the lighting and/or signaling device will be applied on the related vehicle in the position reserved therefor. In other words, when the lighting and/or signaling device is mounted in the vehicle, the conveyor element 56 will be arranged to be substantially perpendicular to the ground or in any case to have such an inclination (for example, slanting) as to convey any liquids towards the ground.

In one embodiment, the conveyor element 56 may have a thickness thinner than or equal to the minimum clearance 48. Obviously, the minimum clearance 48 may vary along the extension of the lenticular body 20 and of the decorative element 28. Therefore, the conveyor element 56 may have a thickness thinner than or equal to the minimum clearance 48 which occurs close to the conveyor element 56 itself.

According to a possible embodiment, at least one filling element 60, impermeable to liquids, adapted to fill at least partially the volume or gap 52, is associated with the internal wall 36 of the decorative element.

Preferably, the filling element 60 is an element elastically compressible inside the volume or gap 52.

For example, the filling element 60 may include an EPDM sponge.

Generally speaking, the filling element 60 may be a spongy element with closed cells, so as not to be able to retain liquids and/or dirt therein. In other words, the filling element 60 may be in a water-repellent material.

According to an embodiment, the filling element 60 is at least partially compressed inside the volume or gap 52.

The decorative element 28 may include a plurality of conveyor elements 56 interspersed with each other by the filling elements 60.

Thereby, preferential outflow paths for any liquids and/or dirt are created so that the latter do not stagnate in the volume or gap 52.

According to an embodiment, the conveyor element 56 and the spacer element 44 coincide with each other. In other words, the same element may act both as a conveyor for liquids/dirt and as a spacer between the lenticular body 20 and the decorative element 28.

In operation, liquids/dirt accumulated in the gap 52 are moved away from the filling elements 60 towards the conveyor element 56, i.e., the spacer element 44. Here, the liquids/dirt are collected in the conveyor element 56, i.e., the spacer element 44, to then slide towards the ground, thus keeping the gap 52 clean.

The assembly method of a lighting and/or signaling device according to the present invention will now be described.

In particular, the method comprises the steps of providing a decorative element 28 and a lenticular body 20 and of associating the decorative element 28 with the lenticular body 20, bringing the at least one welding pin 40 of the decorative element 28 into contact with the external wall 32 of the lenticular body 20.

Figure 6:
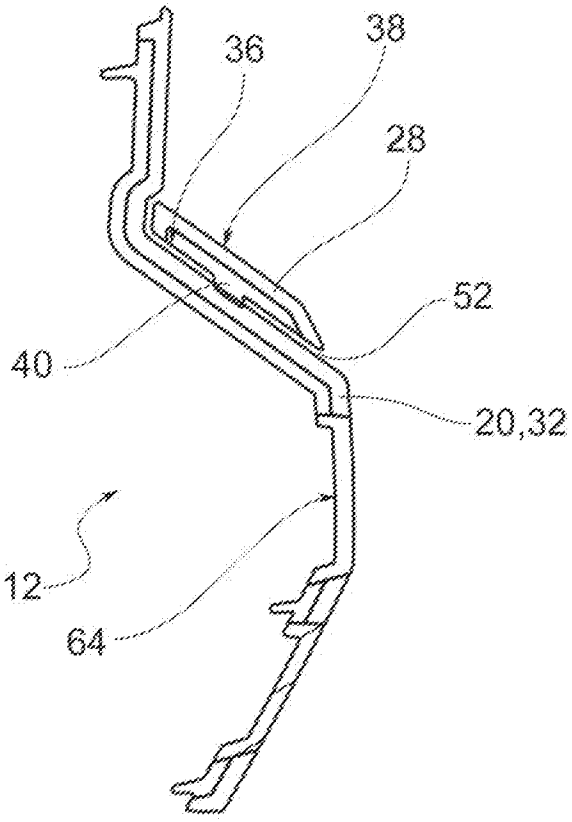
Figure 9A:
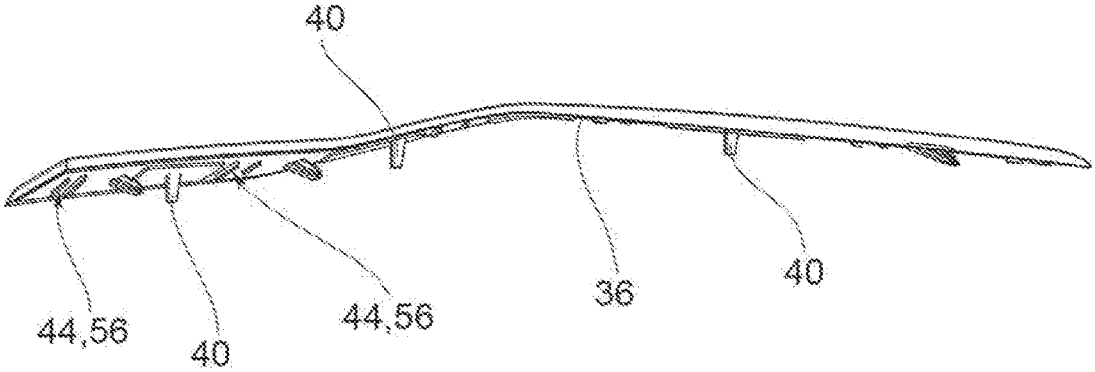
FIG. 9A is a perspective view of a decorative detail of the lighting and/or signaling device shown at a first angle in accordance with the present invention.
Figure 9B:
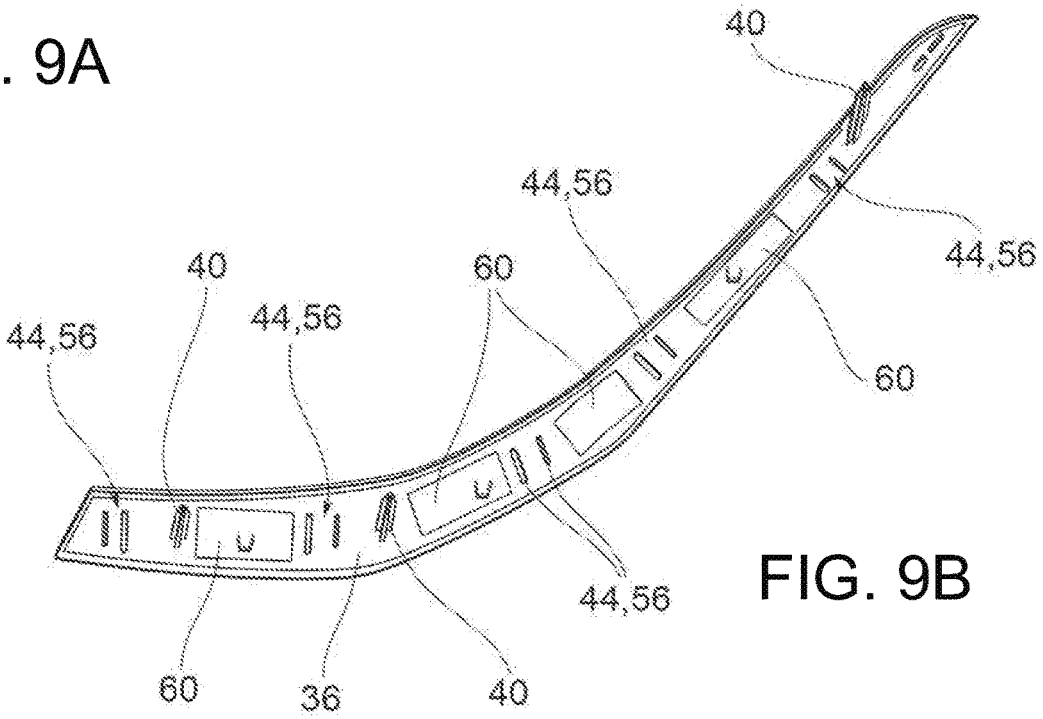
FIG. 9B is a perspective view of a decorative detail of the lighting and/or signaling device shown at a second angle in accordance with the present invention.
Figure 9C:
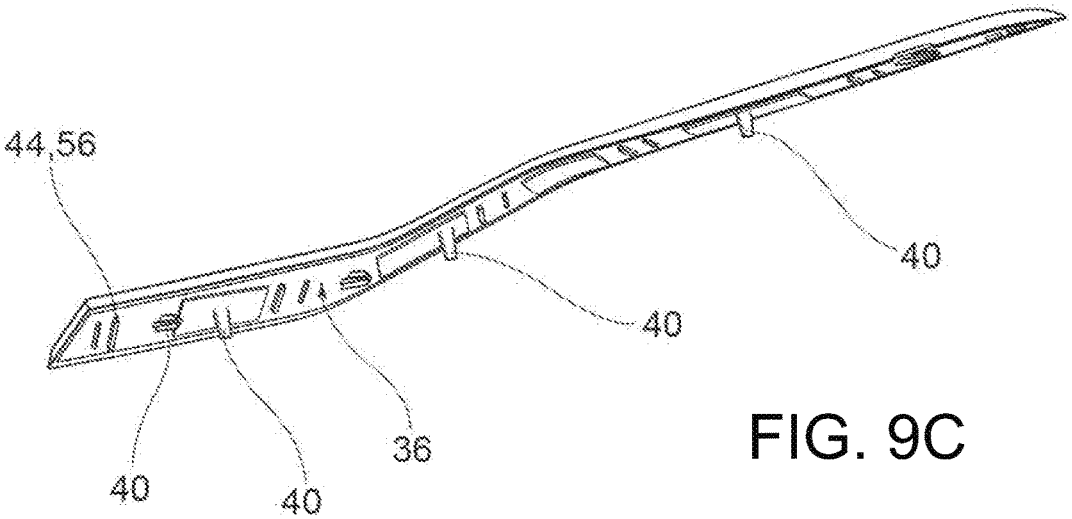
FIG. 9C is a perspective view of a decorative detail of the lighting and/or signaling device shown at a third angle in accordance with the present invention.

In an initial step (FIG. 6), the welding pin 40 protrudes by an amount greater with respect to the overhang of the spacer element 44. In other words, when bringing the welding pin 40 into contact with the external wall 32 of the lenticular body 20, the spacer element does not abut against the external wall 32 itself of the lenticular body 20.

Figure 8:
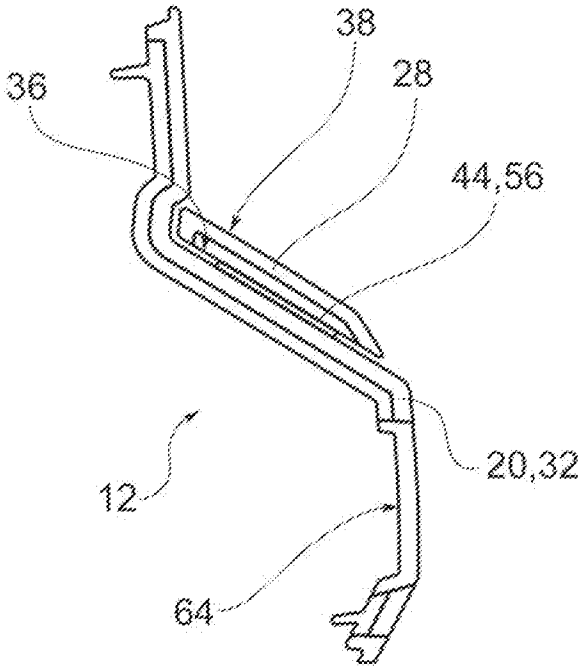
FIGS. 6, 7, and 8 show sectional views of subsequent steps for assembling by welding a lighting and/or signaling device in accordance with the present invention.
Figure 7:
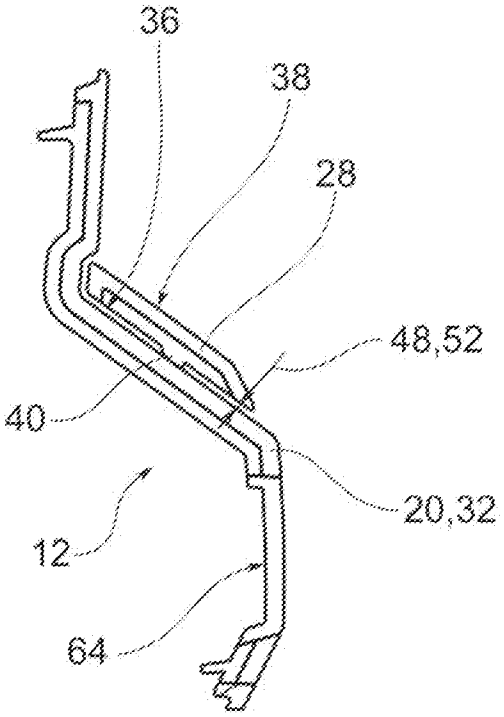

It is then possible to proceed by carrying out the welding, at least partially melting the welding pin 40 until reaching the abutment between the spacer element 44 and the external wall 32 of the lenticular body 20 (FIGS. 7-8).

Thereby, the spacer element 44 ensures the correct mutual positioning (minimum distance) between the decorative element 28 and the lenticular body 20.

In one embodiment, the welding may be a laser welding including the step of directing a laser beam from an internal side 64 of the lenticular body 20, which acts as an element transparent to the laser beam, so as to channel the laser beam into the welding pin 40, which acts as an absorbing element of the laser beam, having been made with an opaque material. Thereby, the overheating and therefore the softening and the welding occurs at an interface between the lenticular body 20 and the welding pin 40.

According to a possible further embodiment, the welding may be an ultrasonic welding, and the welding pin 40 may be made with a clear material.

In the case where it is intended to achieve a decorative element having a chrome plating on the external face 38 thereof, it is possible to proceed with the chroming thereof before carrying out the welding on the lenticular body 20.

In such step of chroming the external face 38 of the decorative element 28, opposite to the internal wall 36, it is necessary to avoid coating the welding pin 40 with chrome.

As it may be appreciated from the description above, the present invention allows to overcome the drawbacks presented in the background art.

In particular, the automotive lighting and/or signaling device according to the present invention makes it possible to associate a decorative element in an economical and at the same time stable and lasting manner.

The automotive lighting and/or signaling device according to the present invention does not provide for the hermetic insulation of the decorative element associated with the lenticular body, but rather provides a gap between the decorative element and the lenticular body, so as to allow the passage and, at the same time, the outflow of liquids, such as water.

In particular, the conveyor elements are arranged and configured so as to favor such downward flow of liquids.

The presence of the filling elements allows at the same time to reduce the liquid inlet volumes and to channel the liquids towards the conveyor elements so that the latter may facilitate the evacuation thereof from the volume between the decorative element and the lenticular body.

Thereby, the water may not stagnate in any way and there is no risk that, by expanding, for example, in the transition to the solid state, it may damage the welding points or the elements of the automotive lighting and/or signaling device themselves.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A lighting and/or signaling device for vehicles, comprising:

a container body which delimits a containment housing closed by a lenticular body, said containment housing accommodating at least one light source adapted to emit a light beam which at least partially crosses the lenticular body, so as to transmit said light beam outside the containment housing, at least one decorative element applied to an external wall of the lenticular body, opposite with respect to the containment housing, wherein an internal wall of the decorative element, directly facing the external wall of the lenticular body, comprises at least one welding pin, which creates a welding point with the lenticular body, at least one spacer element which defines a minimum clearance and a gap between the external wall of the lenticular body and the internal wall of the decorative element, at least one conveyor element which directs the outflow of liquids which have penetrated through said clearance into said gap.

2. A lighting and/or signaling device as set forth in claim 1, wherein said conveyor element has the configuration of a fin having an inclination such as to favor the outflow of liquids downwards.

3. A lighting and/or signaling device as set forth in claim 1, wherein the conveyor element has a thickness thinner than or equal to said clearance.

4. A lighting and/or signaling device as set forth in claim 1, wherein at least one filling element, impermeable to liquids, adapted to fill at least partially said volume, is associated with said internal wall.

5. A lighting and/or signaling device as set forth in claim 4, wherein said filling element is an element elastically compressible inside said volume.

6. A lighting and/or signaling device as set forth in claim 4, wherein said filling element is an EPDM sponge.

7. A lighting and/or signaling device as set forth in claim 4, wherein said filling element is a spongy element with closed cells.

8. A lighting and/or signaling device as set forth in claim 4, wherein said filling element is at least partially compressed inside said volume.

9. A lighting and/or signaling device as set forth in claim 4, comprising a plurality of conveyor elements interspersed with each other by said filling elements.

10. A lighting and/or signaling device as set forth in claim 1, wherein said conveyor element and said spacer element coincide with each other.

11. A lighting and/or signaling device as set forth in claim 1, wherein the welding pin is made of a material opaque to a welding laser.

12. A lighting and/or signaling device as set forth in claim 1, wherein the decorative element, at an external face, opposite to the internal wall, comprises a chromed portion.

13. A lighting and/or signaling device as set forth in claim 1, wherein said at least one decorative element is opaque with respect to said light beam.

14. An assembly method of a lighting and/or signaling device, comprising the steps of:

providing a lighting and/or signaling device wherein said device includes a container body which delimits a containment housing closed by a lenticular body, said containment housing accommodating at least one light source adapted to emit a light beam which at least partially crosses the lenticular body, so as to transmit said light beam outside the containment housing, at least one decorative element applied to an external wall of the lenticular body, opposite with respect to the containment housing, and an internal wall of the decorative element, directly facing the external wall of the lenticular body, comprising at least one welding pin, which creates a welding point with the lenticular body, at least one spacer element which defines a minimum clearance and a gap between the external wall of the lenticular body and the internal wall of the element decorative element, at least one conveyor element which directs the outflow of liquids which have penetrated through said clearance into said gap;

associating the decorative element with the lenticular body, bringing the at least one welding pin in contact with the external wall of the lenticular body, carrying out the welding, melting the welding pin until reaching the abutment between the spacer element and the external wall of the lenticular body.

15. An assembly method as set forth in claim 14, wherein said welding is an ultrasonic welding, or said welding is a laser welding carried out by the step of directing a laser beam from an internal side of the lenticular body, which acts as a transparent element, to the welding pin, which acts as an absorbing element.

16. An assembly method as set forth in claim 14, comprising the step of chroming the external face of the decorative element, opposite to the internal wall, thus avoiding coating said welding pin with chrome.

* * * * *